US011470988B2

(12) United States Patent
Sharon et al.

(10) Patent No.: US 11,470,988 B2
(45) Date of Patent: Oct. 18, 2022

(54) POINT OF SALE DISPLAY INCORPORATING NON-SLIDING, STACKABLE AND UNSTACKABLE PRODUCT TRANSPORT BOXES

(71) Applicants: Arie Sharon, Garland, TX (US); Michael Sharon, Kffar-Sabba (IL); Eliezer Traub, Ramat-Gan (IL)

(72) Inventors: Arie Sharon, Garland, TX (US); Michael Sharon, Kffar-Sabba (IL); Eliezer Traub, Ramat-Gan (IL)

( * ) Notice: Subject to any disclaimer, the term of this patent is extended or adjusted under 35 U.S.C. 154(b) by 0 days.

(21) Appl. No.: 17/327,650

(22) Filed: May 21, 2021

(65) Prior Publication Data

US 2021/0361084 A1 Nov. 25, 2021

Related U.S. Application Data

(60) Provisional application No. 63/101,888, filed on May 21, 2020.

(51) Int. Cl.

| | |
|---|---|
| ***A47F 5/11*** | (2006.01) |
| ***A47B 87/02*** | (2006.01) |
| ***A47B 47/06*** | (2006.01) |

(52) U.S. Cl.

CPC ..... *A47F 5/114* (2013.01); *A47B 47/06* (2013.01); *A47B 87/0207* (2013.01); *A47B 87/0261* (2013.01)

(58) Field of Classification Search

CPC .. A47F 5/114; A47F 5/11; A47F 5/112; A47F 5/116; A47F 5/0018; B65D 5/001; B65D 5/003; B65D 5/0035; B65D 21/0219; B65D 21/0222; B65D 21/0223; A47B 43/02; A47B 55/06; A47B 47/0091; A47B 87/02; A47B 47/06; A47B 87/0207; A47B 87/0253; A47B 87/0261; A47B 87/0269

USPC ..... 211/126.6, 59.4, 188, 194, 126.16, 72, 211/135, 132.1, 126.2, 126.12, 73; 206/504, 509; 229/169, 178, 915, 916, 229/120.011

See application file for complete search history.

(56) References Cited

U.S. PATENT DOCUMENTS

| | | | | |
|---|---|---|---|---|
| 3,552,579 A * | 1/1971 | Simon | ..... | A47B 87/02 211/126.12 |
| 4,318,474 A * | 3/1982 | Hasegawa | ..... | B65D 5/542 206/199 |
| 4,436,243 A * | 3/1984 | Nason | ..... | B65D 5/38 229/120.17 |

(Continued)

*Primary Examiner* — Jennifer E. Novosad
(74) *Attorney, Agent, or Firm* — Blynn L. Shideler; Krisanne Shideler; BLK Law Group

(57) ABSTRACT

A point of sale display includes at least two stacked product transport boxes each having a planar bottom and planar top; a pair of locking tabs on one of the planar bottom or planar top of each box, each locking tab having a hinge and sides extending therefrom; a pair of receiving openings on one of the planar bottom or planar top of each box, wherein the pair of receiving opening on one of the stacked boxes align with the pair of locking tabs on the other such that the locking tabs on the stacked boxes are selectively pivoted through the openings of the adjacent box to interconnect the boxes and prevent relative sliding, and wherein the pair of locking tabs has one of straight sides or an inwardly tapered trapezoidal shape extending from the hinge to allow the boxes to be separated.

16 Claims, 8 Drawing Sheets

(56) References Cited

U.S. PATENT DOCUMENTS 4,537,344 A * 8/1985 Thomas ..... B65D 5/003 206/509
4,946,042 A * 8/1990 Ferreri ..... B65D 5/5405 229/241
5,193,466 A * 3/1993 Eder ..... A47F 5/116 108/166
5,364,021 A * 11/1994 Munk ..... B65D 75/14 229/92.8
5,549,241 A * 8/1996 Correll ..... B65D 5/32 229/120.01
5,662,508 A * 9/1997 Smith ..... A63H 33/04 446/128
5,667,287 A * 9/1997 Gunning ..... A47B 81/068 312/108
5,706,959 A * 1/1998 Smith ..... A47F 5/0018 108/165
5,758,783 A * 6/1998 Maglione ..... A47B 87/0207 211/126.16
5,947,292 A * 9/1999 Chelfi ..... B65D 5/2038 206/509
5,984,120 A * 11/1999 Johnske ..... A47F 5/114 211/126.16
6,234,385 B1 * 5/2001 Espinoza ..... B65D 5/2038 229/122
6,257,411 B1 * 7/2001 Bacques ..... B65D 5/001 206/508
6,427,907 B1 * 8/2002 Espinoza ..... B65D 5/2038 229/122
6,431,436 B1 * 8/2002 Evers ..... B65D 5/443 229/120.01
6,502,698 B1 * 1/2003 McKenna ..... B65D 5/0015 206/509
6,712,214 B1 * 3/2004 Wintermute ..... B65D 5/006 206/745
6,935,504 B2 * 8/2005 Ritter ..... B65D 5/003 206/511
7,182,415 B2 * 2/2007 Yamada ..... A47B 87/02 312/107
7,607,566 B2 * 10/2009 Philips ..... B65D 5/16 229/157
8,360,255 B2 * 1/2013 Chen ..... A47B 87/0269 211/135
8,640,871 B2 * 2/2014 Moss ..... B65D 5/0035 206/512
8,690,047 B2 * 4/2014 McKenna ..... B65D 5/002 229/143
9,290,288 B1 * 3/2016 Ikeno ..... A47F 5/112
9,475,603 B2 * 10/2016 Jacomelli ..... B65D 25/00
9,522,761 B2 * 12/2016 Baker ..... B65D 5/0015
9,611,072 B2 4/2017 Sharon
9,826,843 B1 * 11/2017 Tomaszewski ..... B65D 5/002
10,703,528 B2 * 7/2020 Delause ..... B31B 50/59
10,897,872 B2 1/2021 Tsai
11,161,643 B2 * 11/2021 Aziz ..... B65D 5/48038
2004/0149815 A1 * 8/2004 Holdsworth ..... B65D 5/0035 229/164
2004/0217077 A1 * 11/2004 Gerstner ..... A47F 1/126 211/194
2007/0246398 A1 * 10/2007 Pedler ..... A47F 5/112 206/745
2010/0219232 A1 * 9/2010 Smith ..... B65D 5/443 229/108
2011/0000957 A1 * 1/2011 Delause ..... B65D 5/001 493/84
2013/0213847 A1 * 8/2013 Moreau ..... B65D 5/001 206/509
2014/0113789 A1 * 4/2014 Aganovic ..... B31B 50/0044 493/162
2015/0021226 A1 * 1/2015 Jacomelli ..... B65D 5/005 206/508
2016/0144994 A1 * 5/2016 Flaming ..... B65D 5/0015 206/509
2021/0361084 A1 * 11/2021 Sharon ..... A47F 5/114

* cited by examiner

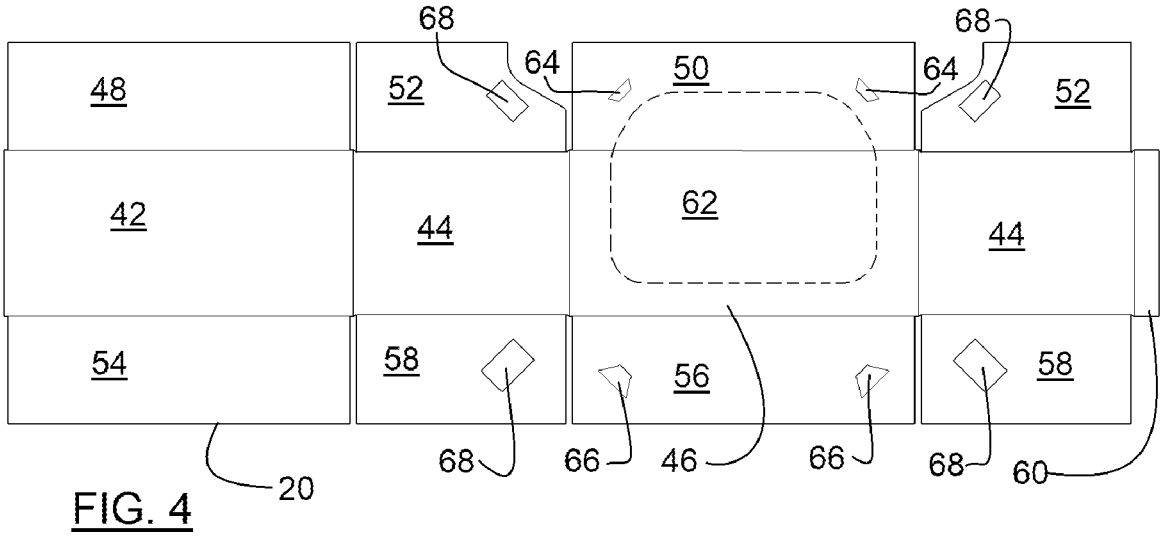
FIG. 4
FIG. 5A
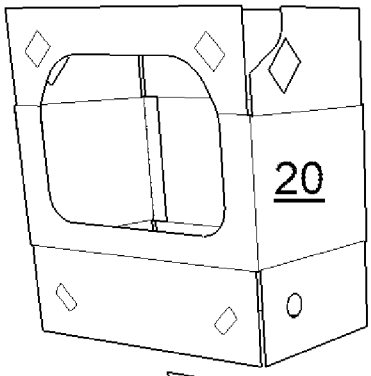
FIG. 5B
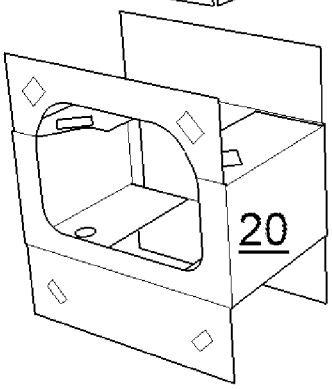
FIG. 5C
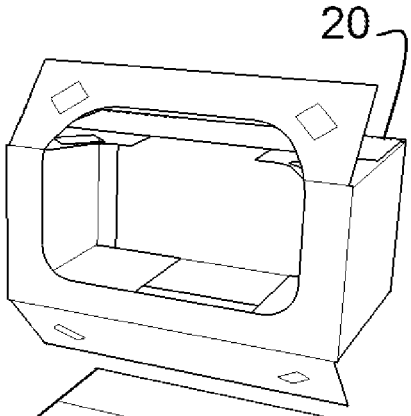
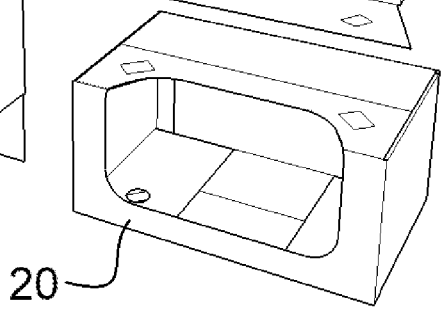
FIG. 5D FIG. 6A
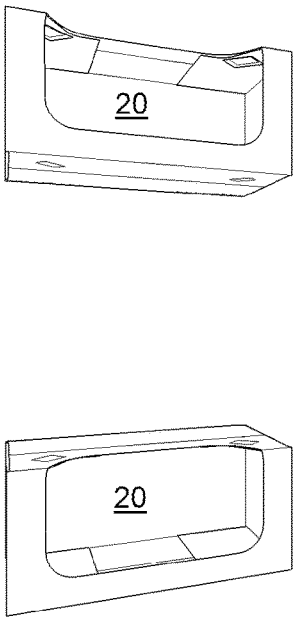
FIG. 6B
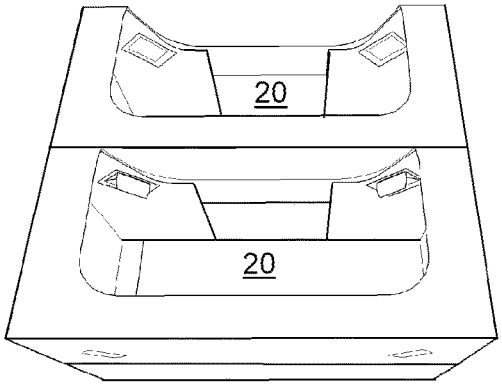
FIG. 6C
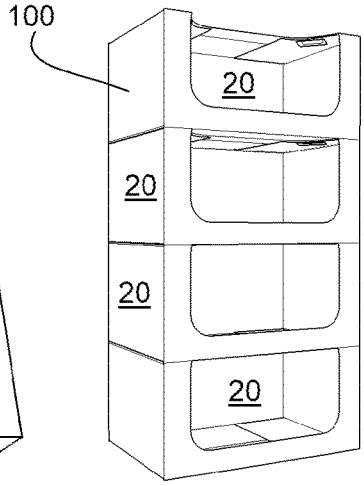
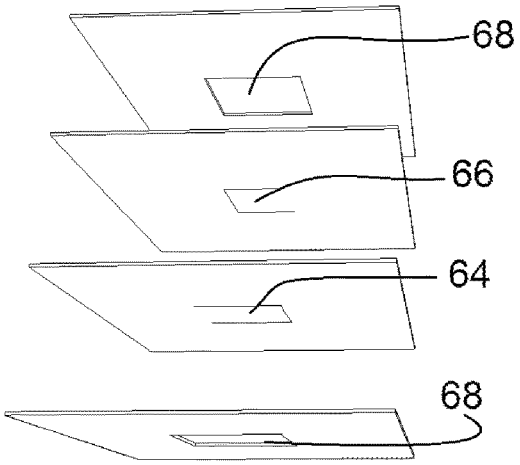
FIG. 7A
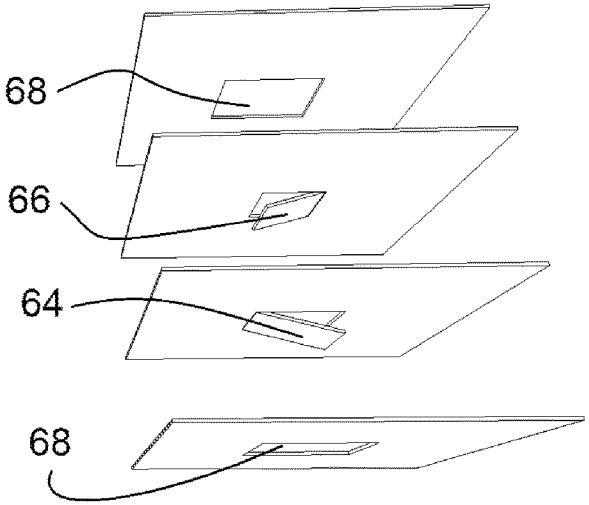
FIG. 7B

POINT OF SALE DISPLAY INCORPORATING NON-SLIDING, STACKABLE AND UNSTACKABLE PRODUCT TRANSPORT BOXES

RELATED APPLICATIONS

The present application claims the benefit of U.S. Provisional Patent Application Ser. No. 63/101,888 filed May 21, 2020 titled "Non-Sliding stackable Boxes" which is incorporated herein by reference.

BACKGROUND OF THE INVENTION

1. Field of the Invention

This invention generally relates to flat pack boxes integrated into a point of sale display, more specifically to flat pack boxes that are stackable and interconnected to form a free standing display unit.

2. Background Information

A point-of-sale display (POS display) is a specialized form of sales promotion that have been given the name as they are often found near, on, or next to a checkout counter (i.e. the "point of sale"). They are found throughout commercial establishments. They are intended to draw the customers' attention to products, which may be new products, or on special offer, and are also used to promote special events, e.g. seasonal or holiday-time sales. POS displays can include free standing display units, shelf edging, dummy packs, strut cards, standees, hanging signs, counter display units (CDU), display packs, endcaps, display stands, mobiles, posters, and banners. POS, in a separate context not relevant for this application, also refers to systems used to record transactions between the customer and the commerce.

The present invention is primarily directed to free standing display units which are generally designed to attract the attention of customers and promote key retail products or messages. They are often placed strategically within the customer journey, and utilize bright colors and graphics to stand out visually and encourage shoppers to buy. Free standing display units are generally made from cardboard which reduces production costs, and makes them easy to transport and assemble, at the same time as being robust enough for use in a busy retail environment. Cardboard may refer to a variety of heavy paper-like materials, however within the meaning of this application the term cardboard will reference card stock, corrugated fiberboard, or paperboard.

As a brief history on cardboard boxes, the first commercial paperboard box, which was not corrugated, is sometimes credited to the firm M. Treverton & Son in England in 1817. (*Marketing Communications*, Volume 6, Issues 7-12, United Business Publications (1981)). Cardboard box packaging was also made the same year in Germany. The pre-cut cardboard or paperboard flat pack box was invented in 1890. The advent of lightweight flaked cereals, such as popularized by the Kellogg Company, greatly increased the commercial use of cardboard boxes. The first corrugated cardboard box manufactured in the US was in 1895 and by the early 1900s, wooden crates and boxes were being replaced by corrugated paper shipping cartons. The U.S. Patent system has long illustrated the ingenuity of flat pack containers, such as the 1894 U.S. Pat. No. 529,053 for a "Paper Pail", which was later emblazoned with the graphical image of a pagoda, and has become well known as the now ubiquitous "Chinese food" take out container.

The phrase "flat pack" within the meaning of the present application references products assembled from a one or more planar components that are assembled to the desired product. The phrase "flat pack" is often used in referencing furniture. In the field of the present invention, namely boxes, trays and bases, this phrase "flat pack" can be equated with the phrase "knock down." See, for example, the "Corrugated Plastic Knockdown Tray" sold by Minnesota Diversified or the "Knock Down Storage Box" sold by Bigso Box of Sweden. The terms "Collapsible" and "Foldable", and similar terms, have also been used in this industry to convey the same concept and can also accurately describe aspects of the present invention.

The terms "boxes", "trays" and "bases" as used herein do not have consistent and precise definition in the art. The terms boxes and trays have been interchangeably used together with the terms container, bin, receptacle, crate, chest, trunk, carton, and a host of other similar terms. A "box" within the meaning of this application will generally describe a structure with a bottom, top and sides forming a container. A "tray" within the meaning of this application will generally describe herein a structure with a bottom and sides, but no top, forming a container. Even with these working definitions there is some overlap in the terms, for example, a box with a separable lid can be converted to a tray within the meaning of this application with the removal of the lid.

Within the meaning of the present application the phrase "storage box" or "storage tray" defines a container with substantially vertical sides (+/−7 degrees), and the phrase "flared sided box" or "flare sided tray" defines a container with non-vertical sides that extend upward at an angle of more than 7 degrees from vertical and less than 75 degrees from vertical. Flared sided trays may be nested together. Additionally there is what is known as a "knock out display" box that is a product shipping box that includes a removable panel, aka knock out panel, to allow easy access for the products stored in the box through a window formed by removal of the knock out panel, whereby the shipping box is typically placed directly on a store shelf or within a point of sale display and the panel is removed.

In many commercial establishments there is a requirement to elevate products, mostly food products, on sale off of the floor, such as on store shelving. Free standing display units must also incorporate these requirements to elevate products the requisite distance. Some free standing display units use a base to accommodate this requirement. The term base, within the meaning of this application, will define a structure that can raise boxes or trays incorporated into a free standing display unit this minimal distance off of the floor. It should be apparent that a base need not be on a floor and that a base of a free standing display unit could be positioned on a counter (where such a base structure may not technically be required, but it is used as it is part of the overall free standing display unit design)

There remains a need in the art to design cost effective, efficient and effective flat pack boxes that are stackable and interconnected to form a free standing display unit.

SUMMARY OF THE INVENTION

The various embodiments and examples of the present invention as presented herein are understood to be illustrative of the present invention and not restrictive thereof and are non-limiting with respect to the scope of the invention.

The present invention provides a point of sale display incorporating stackable and unstackable product transport boxes.

One aspect of the present invention provides a point of sale display comprising at least two stacked product transport boxes each having a planar bottom and planar top; at least a pair of locking tabs on one of the planar bottom or planar top of each box, each locking tab having a hinge on one end and sides extending from the hinge; at least a pair of receiving openings on one of the planar bottom or planar top of each box, wherein the pair of receiving opening on one of the stacked boxes align with the pair of locking tabs on the other of the stacked boxes such that the locking tabs on the stacked boxes are selectively pivoted through the openings of the adjacent box to interconnect the boxes and prevent relative sliding in the point of sale display, and wherein the pair of locking tabs has one of straight sides or an inwardly tapered trapezoidal shape extending from the hinge to allow the boxes to be separated by pulling up on an upper box of the assembled and interconnected boxes.

One aspect of the invention provides A point of sale display comprising at least two stacked product transport boxes each having a planar bottom and planar top; at least a pair of locking tabs on one of the planar bottom or planar top of each box, each locking tab having a hinge on one end and sides extending from the hinge; and at least a pair of receiving openings on one of the planar bottom or planar top of each box, wherein each receiving opening is formed by receiving tabs each having a hinge, wherein each of the receiving openings on one of the stacked boxes align with one of the locking tabs on the other of the stacked boxes such that the locking tabs on the stacked boxes are selectively pivoted through the openings of the adjacent box to interconnect the boxes and prevent relative sliding in the point of sale display, wherein the receiving tabs have hinges on an opposite side from the location of the hinges of the associated locking tabs.

One aspect of the invention provides a point of sale display comprising at least two stacked product transport boxes each having a planar bottom and planar top; at least a pair of locking tabs on one of the planar bottom or planar top of each box, each locking tab having a hinge on one end and sides extending from the hinge; At least a pair of receiving openings on one of the planar bottom or planar top of each box, wherein each of the receiving openings on one of the stacked boxes align with one of the locking tabs on the other of the stacked boxes such that the locking tabs on the stacked boxes are selectively pivoted through the openings of the adjacent box to interconnect the boxes and prevent relative sliding in the point of sale display, and wherein the hinges on at least two of the locking tabs are angles relative to each other.

These and other advantages of the present invention will be clarified in the description of the preferred embodiments taken together with the attached figures.

BRIEF DESCRIPTION OF THE DRAWINGS

FIG. 4 is a plan view of a cut flat substrate forming a flat pack stackable interconnecting box which can be incorporated into a modified free standing display unit of FIG. 1.

FIGS. 5A-5D schematically illustrate a sequential assembly of a modified flat pack stackable interconnecting box formed from a flat substrate which can be incorporated into a modified free standing display unit of FIG. 1.

FIGS. 6A-6C schematically illustrate a sequential assembly of a modified free standing display unit incorporating the boxes of FIG. 5D.

FIGS. 7A-B are exploded schematic perspective views of the aligned locking tabs and the associated receiving tabs and the associated access openings in the interconnection of components of the free standing display unit according to one embodiment of the present invention.

DESCRIPTION OF THE PREFERRED EMBODIMENTS

Figure 1:
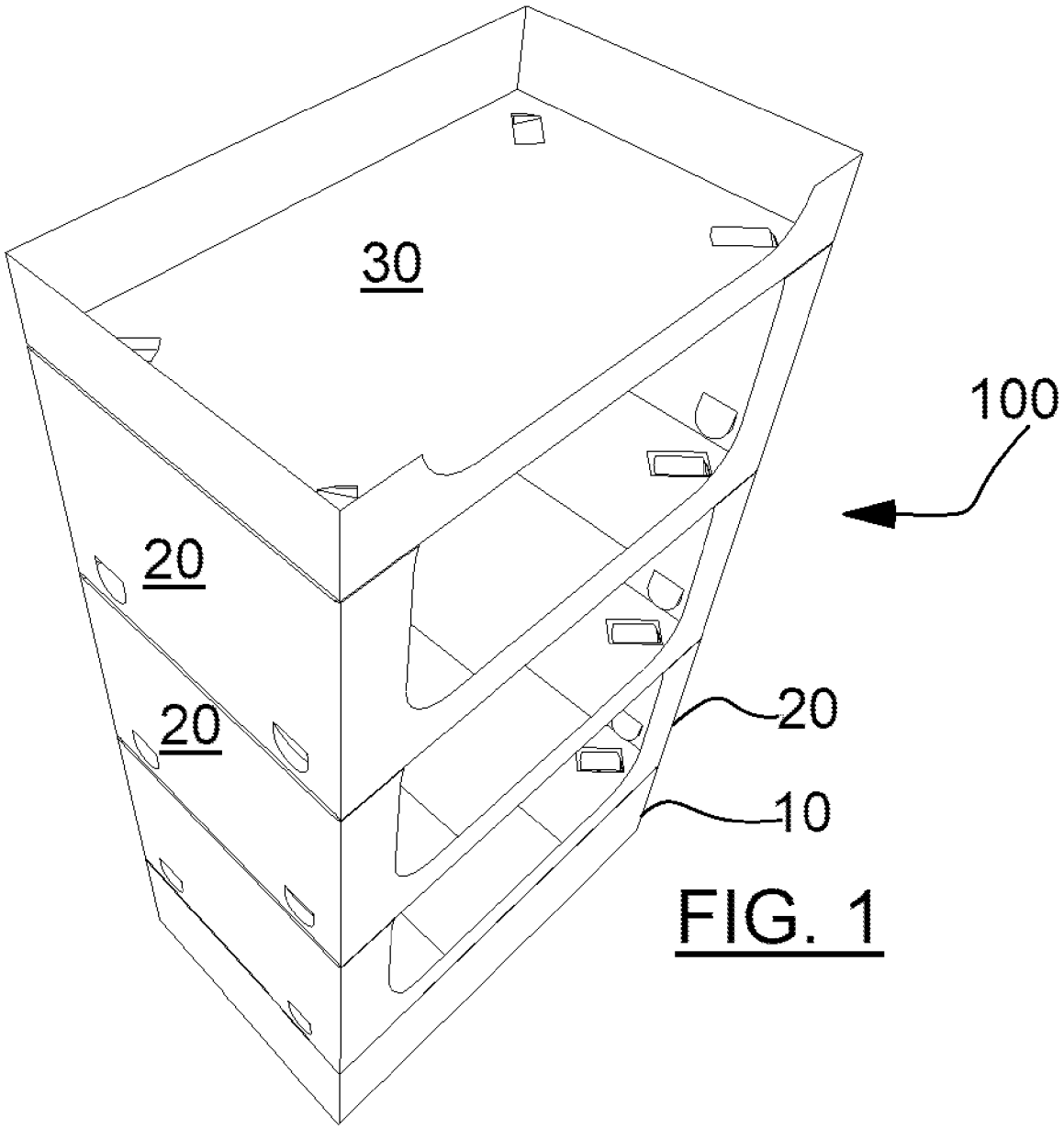
FIG. 1 is a perspective view of a free standing display unit incorporating flat pack boxes that are stackable and interconnected to form the free standing display unit in accordance with a first embodiment of the present invention.
Figure 2:
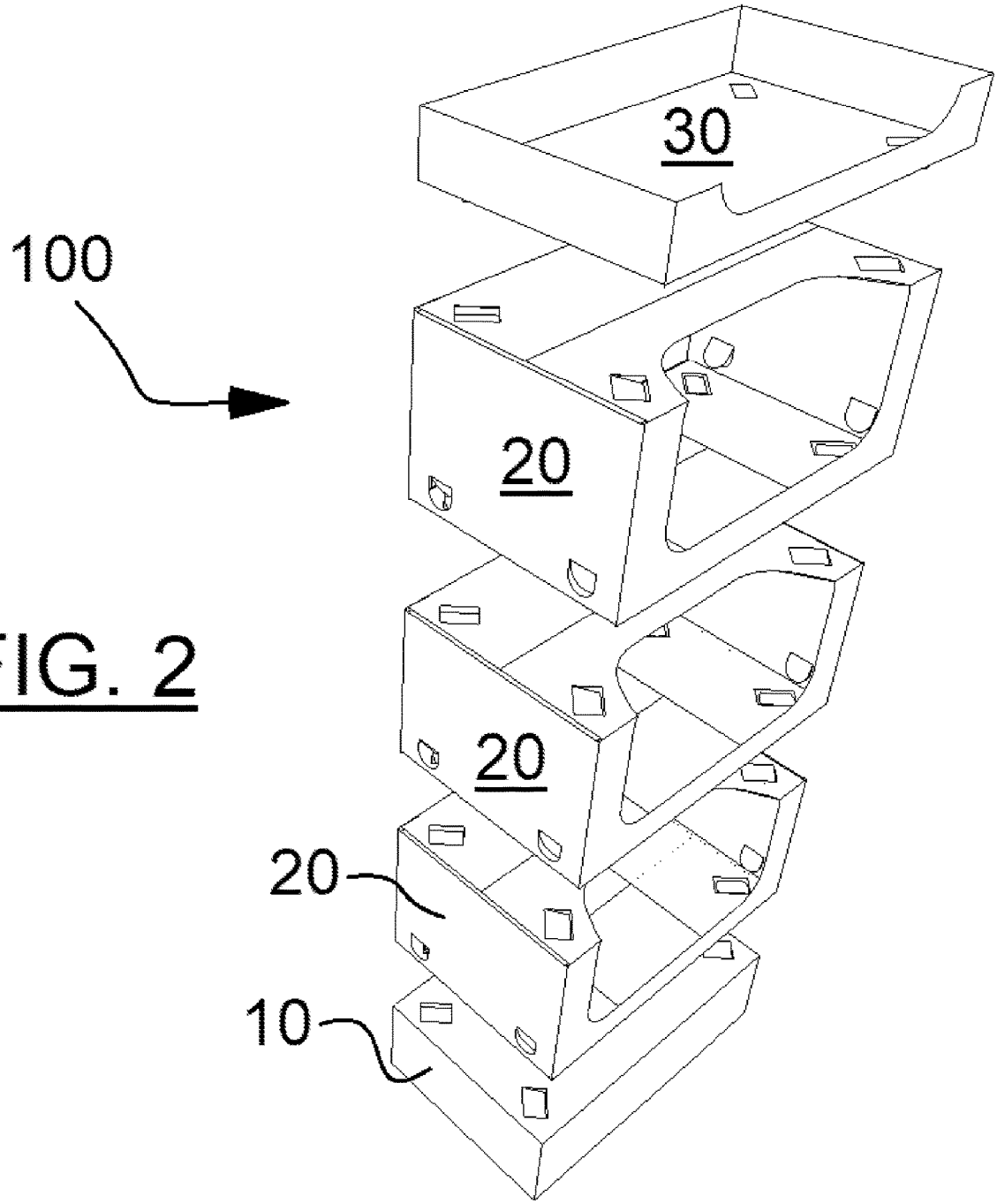
FIGS. 2 and 3 are exploded perspective views of the free standing display unit of FIG. 1.
Figure 3:
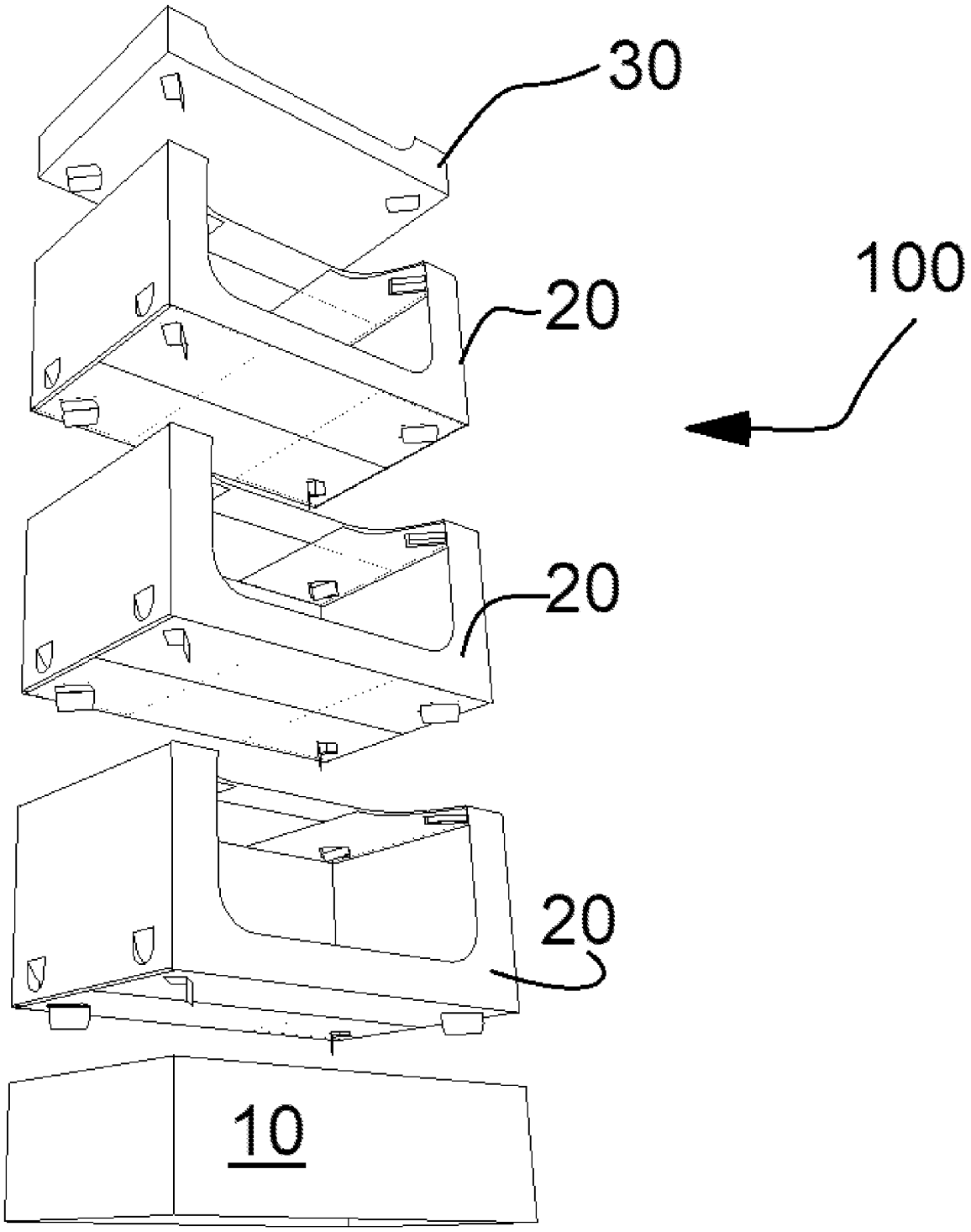

The present invention provides a point of sale display 100 incorporating stackable and unstackable product transport boxes 20. FIG. 1 is a perspective view of a point of sale display in the form of a free standing display unit 100 incorporating flat pack boxes 20, product transport boxes that are stackable and interconnected as discussed below to form the free standing display unit 100 in accordance with a first embodiment of the present invention. The free standing display unit 100 further includes a lower base 10 and an upper tray 30. FIGS. 2 and 3 are exploded perspective views of the free standing display unit of FIG. 1. The free standing display unit 100 of FIG. 1 is particularly useful for grouping elements together that are suitable for both a tray 30 and the storage box 20 with knock out panel 62 removed, such as for example chips and dip or tortilla and salsa. Dip/salsa is often in containers suitable for display in a tray 30 while bags of chips are well suited for the knock out storage box 20. Another alternative would be hamburger buns, hot dog buns and condiments, wherein condiments are well suited for the tray 30 while the hot dog buns and the hamburger buns are well suited for the storage boxes 20 whereby the unit 100 simultaneously accommodates each of these. A S'mores display with gram crackers, chocolate and marshmallows represents another alternative suitable for the display 100. In addition to allowing for the display of a combination of a variety of elements, the present invention allows the unit 100 to be unstacked as discussed below and select elements replaced to restock or even alter the display of unit 100 quickly and easily.

The base 10, boxes 20 and tray 30 are each preferably flat pack or knock down products assembled from a single generally die cut planar component. The base 10, boxes 20 and tray 30 can be made of any suitable material although cardboard, plastic, corrugated plastic cardboard is preferred and cardboard is most preferred as it is efficient and cost effective and the ease of recycling offers a distinct advantage.

As further detailed below, the boxes 20 when integrated within the free standing display unit 100 yield a non-sliding six sided box with a top and a bottom, and can have window opening on its walls formed by a removable knock out panel 62 to allow user's to be able to reach inside to access the products (not shown). The bottom surface of the non-sliding boxes 20 (and on the tray 30) have at least two pre-cut locking tabs 66 that are flat with the surface. The locking tabs 66 have folding lines so they can be pushed out and swing out of the box 20. On the top surface of non-sliding boxes 20 (and on the base 10) and aligned with the locking tabs 66 on the bottom of the adjacent box 20 or tray 30, are pre-cut receiving tabs 64 or at least openings (which openings are formed by the tabs 64).

When a user stacks one non-sliding box 20 on top of another same non-sliding box 20 (or on the base 10), and the boxes 20 (or box 20 and base 10) are aligned with each other, the flat locking tabs 66 on the bottom of upper box 20 (or tray 30) will align and seat right on top of the flat receiving tabs 64 of that are on top of the box 20 under it. When two structures and their tabs 64 and 66 are aligned and stacked on top of each other, and the locking tabs 66 from one box 20 (or upper tray 30) are pushed and swing out, they will push and swing-in the receiving tabs 64 from the other box 20 (or base 10), and they will also will be positioned within the other box 20 (or base 10). This way, when the boxes 20 are stacked on each other, and the tabs 64 and 66 are activated and pushed out and in to the other box 20, the boxes 20 cannot slide on top of each other. In order to separate the boxes 20, the user need only lift directly up, whereby the tabs from one box 20 or tray 30 will withdraw from the other box 20 or base 10.

FIG. 4 is a plan view of a cut flat substrate forming a modified flat pack stackable interconnecting box 20 which can be incorporated into a modified free standing display unit 100 of FIG. 1. The box 20 is generally a six-sided box having a back 42, sides 44, front 46, outer back top flap 48, outer front top flap 50, inner side top flaps 52, outer back bottom flap 54, outer front bottom flap 56, inner side bottom flap 58, glue panel 60, and knock out panel 62 in a generally conventional fashion. Living hinges or fold lines will be between the back 42 and the adjacent side 44, adjacent outer back top flap 48 and the adjacent outer back bottom flap 54. Living hinges or fold lines will be between the side 44 and the adjacent inner side top flange 52, the adjacent front 46 and the adjacent inner side bottom flap 58. Living hinges or fold lines will be between the front 46 and the adjacent outer front top flap 50, and the adjacent other distal side 44, and the adjacent outer front bottom flap 56. Living hinges or fold lines will be between the other distal side 44 and the adjacent inner side top flange 52, the glue strip 60 and the adjacent inner side bottom flap 58. The knock out panel 62 may be formed with perforations for easy removal and may be on the front 46 and a portion of the outer front top flap 50, and with this structure the inner side top flanges 52 may have an outer periphery that aligns with the window formed by removal of the panel 62. Alternatively the panel 62 may be formed entirely within the front 46. The present invention is illustrated with a conventional six sided storage box 20, but could be implemented on any box having flat bottom and top for stacking, including hexagon, or triangular shaped boxes or flared boxes. The six sided box 20 shown is preferred as it is well known and accepted in the industry and represents minimal waste in cutting from a substrate. The use of the glue strip 60 and adhesives for assembling the box 20 is known in the art, but it is possible to use interconnecting elements to form an adhesive free assembly if desired (but such structures add to the assembly time and complexity and possibly to the waste and are not necessary for the implementation of the present invention.

A key aspect of the present invention is the formation of the interconnecting structure between adjacent boxes 20, or between the top tray 30 and the top box 20 or the bottom box 20 and the base 10. The modified box of FIG. 4 uses only two locking and receiving tabs 64 and 66 rather than four. The outer front bottom flap 56 includes two flat locking tabs 66 and the outer front top flap 56 includes two receiving tabs 64, whereby the locking tabs 66 are positioned on the bottom of box 20 (or tray 30) and will align and seat right on top of the flat receiving tabs 64 of that are on top of the box 20 (or base 10) under it. The locking tabs 66 include a living hinge or fold line on one edge, the longer of the trapezoidal bases.

The locking tabs 66 are shown as inwardly tapered trapezoidal shapes to allow the boxes 20 to be separated by pulling up on the upper box 20 (or tray 30) of the assembled and interconnected boxes 20. A straight sided locking tab 66 could also be used but the inward tapered as shown is preferred. A circle tab or outwardly tapered tab would have the lower portion of the tab impinge when the box 20 is lifted up for unstacking the boxes 20 and could rip and tear preventing reassembly of another replacement box 20 in the free standing display unit 100 (unless the tabs 66 are manually reset as discussed below in connection with the embodiment of FIG. 11).

The receiving tabs 64 are also formed with a living hinge and a shape commentary to the locking tab 66 and a position aligned with the locking tabs of an adjacent box 20 or tray 30. Preferably the receiving tabs 64 have a living hinge opposite from the side of the living hinge on the locking tabs 66 as detailed further below. As noted above, when tabs 64 and 66 of adjacent boxes 20 are aligned and stacked on top of each other, and the locking tabs 66 from one box 20 (or upper tray 30) are pushed and swing out, they will push and swing-in the receiving tabs 64 from the other box 20 (or base 10), and they will also will be positioned within the other box 20 (or base 10). This way, when the boxes 20 are stacked on each other, and the tabs 64 and 66 are activated and pushed out and in to the other box 20, the boxes 20 are removably interconnected and cannot slide on top of each other.

There can be some movement if only one locking tab 66 is deployed, as the interconnected upper box 20 can move slightly relative to the lower box 20 in a direction perpendicular to the living hinge of the tab 66. For this reason the living hinges of each of the two tabs 66 are non-parallel and angled relative to each other (generally perpendicular) and the deployment of the two tabs 66 with perpendicular living hinges will securely hold the adjacent structures without even minimal relative lateral movement.

The invention includes access openings 68 on the inner side top flanges 52 and the inner side bottom flaps 58 that align with the tabs 66 and 64 and allow operation without interferences. The shape of these opening must be sufficient to allow easy operation of the tabs 64 and 66 and can take generally any form.

FIGS. 5A-5D schematically illustrate a sequential assembly of a modified flat pack stackable interconnecting box formed from a flat substrate which can be incorporated into a modified free standing display unit of FIG. 1. The substrate forming the box 20 of FIG. 5D is substantially the same as shown in FIG. 4 except that the tabs 64 and 66 are shown as straight sided instead of tapered trapezoid structure. Additionally the access openings 68 on the inner side bottom flaps 58 are circular. These two distinctions are mainly to illustrate alternative possibilities for the present invention. FIG. 5A shows the initial step of aligning and coupling the glue strip 60 to the back 42, and the next step shown in FIG. 5B is folding the inner flaps 52 and 58 into position, followed by securing, such as by gluing, the outer flaps 48, 50, 54 and 56 into position as shown in FIGS. 5C and 5D to finish the box 20. In this assembly illustration the panel 62 was shown as removed merely for clarity. In most instances this knock out panel 62 will remain in place during product shipment and will be removed by the user as the box 20 becomes a point of sale display, either on a shelf or the like, or within the point of sale display 100 of the present invention.

The tray 30 can be formed in a conventional fashion except that the lower portion or bottom includes locking tabs 66 as in the box 20 discussed above and which cooperate with the receiving tabs 64 of a lower adjacent box 20. In a similar manner the construction of the base 10 is generally known except for the inclusion of receiving tabs 64 in an upper surface thereof as in the box 20 discussed above and which cooperate with the locking tabs 66 of an upper adjacent box 20.

FIGS. 6A-6C schematically illustrate a sequential assembly of a modified free standing display unit 100 incorporating the boxes 20 of FIG. 5D. The free standing display unit 100 of FIG. 6C is formed of four flat pack, knock out storage boxes 20. If required, the display unit 100 of FIG. 6C could include a base 10.

FIGS. 7A-B schematically illustrate the relative positioning of the locking tabs 66 and the associated receiving tabs 64 together with the access openings 68 in the interconnection of the boxes 20 (and or bases 10 and tray 30) of the unit 100 of the present invention. These figures best illustrate the preferred embodiment of having the fold line or living hinge of the locking tabs 66 be opposed from the living hinges of the receiving tabs 64. Additionally as can be seen they are constructed such that pressing on the locking tab 66 will engage the receiving tab 64 at a location spaced from the living hinge of the receiving tab 64 to allow for the easy movement of the receiving tab 64.

Figure 8A:
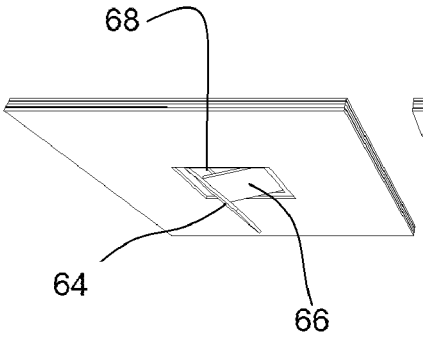
FIGS. 8A-C schematically illustrate the sequential deployment of the aligned locking tabs and the associated receiving tabs in the interconnection of components of the free standing display unit according to one embodiment of the present invention.
Figure 8B:
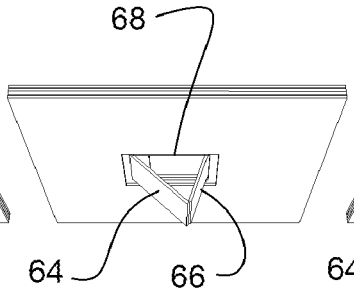
Figure 8C:
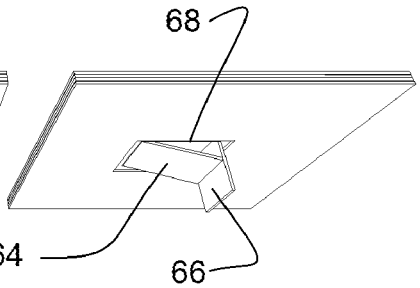

FIGS. 8A-C schematically illustrate the sequential deployment of the aligned locking tabs 66 and the associated receiving tabs 64 in the interconnection of components, namely adjacent boxes 20, an adjacent tray 30 and box 20 or an adjacent box 20 and base 10, of the free standing display unit 100 according to one embodiment of the present invention. As shown herein the receiving tabs 64 have a living hinge "opposite" from the side of the living hinge on the locking tabs 66, which can be defined as an orientation having one of the tabs 66 or 64 rotating clockwise during initial deployment and the other tab 64 or 66 of the pair simultaneously moving counterclockwise in the initial deployment of FIGS. 8A-B. Pressing on the locking tab 66 will push the tab 66 into the receiving tab 66 and cause both to pivot (clockwise and counterclockwise) into the adjacent box 20 or base 10 as shown in FIG. 8A until the locking tab 66 advances past the end of the receiving tab 64 as shown in FIG. 8B. The elastic memory of the cardboard of the receiving tab 64 will cause it to spring back partially to a holding position shown in FIG. 8C. The holding position will generally keep the locking tab vertical as shown locking the elements together relative to lateral movement while still allowing the elements to be separated with a vertical lifting motion.

Figure 9A:
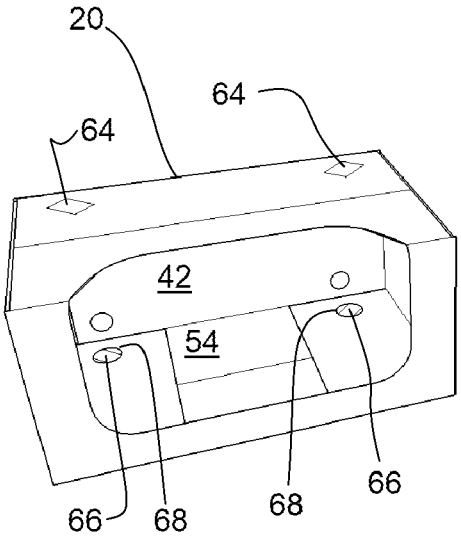
FIGS. 9A-B are perspective front and rear views of a modified flat pack stackable interconnecting box formed from a flat substrate which can be incorporated into a modified free standing display unit of FIG. 1.
Figure 9B:
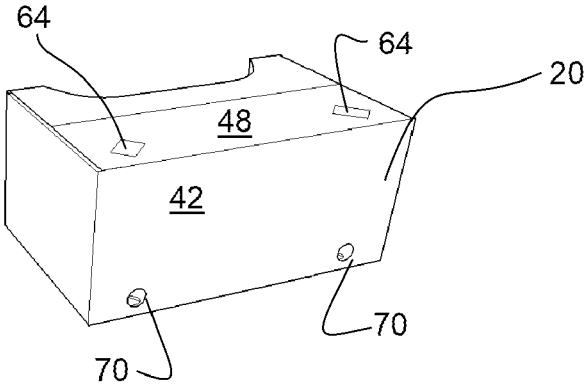
Figure 10:
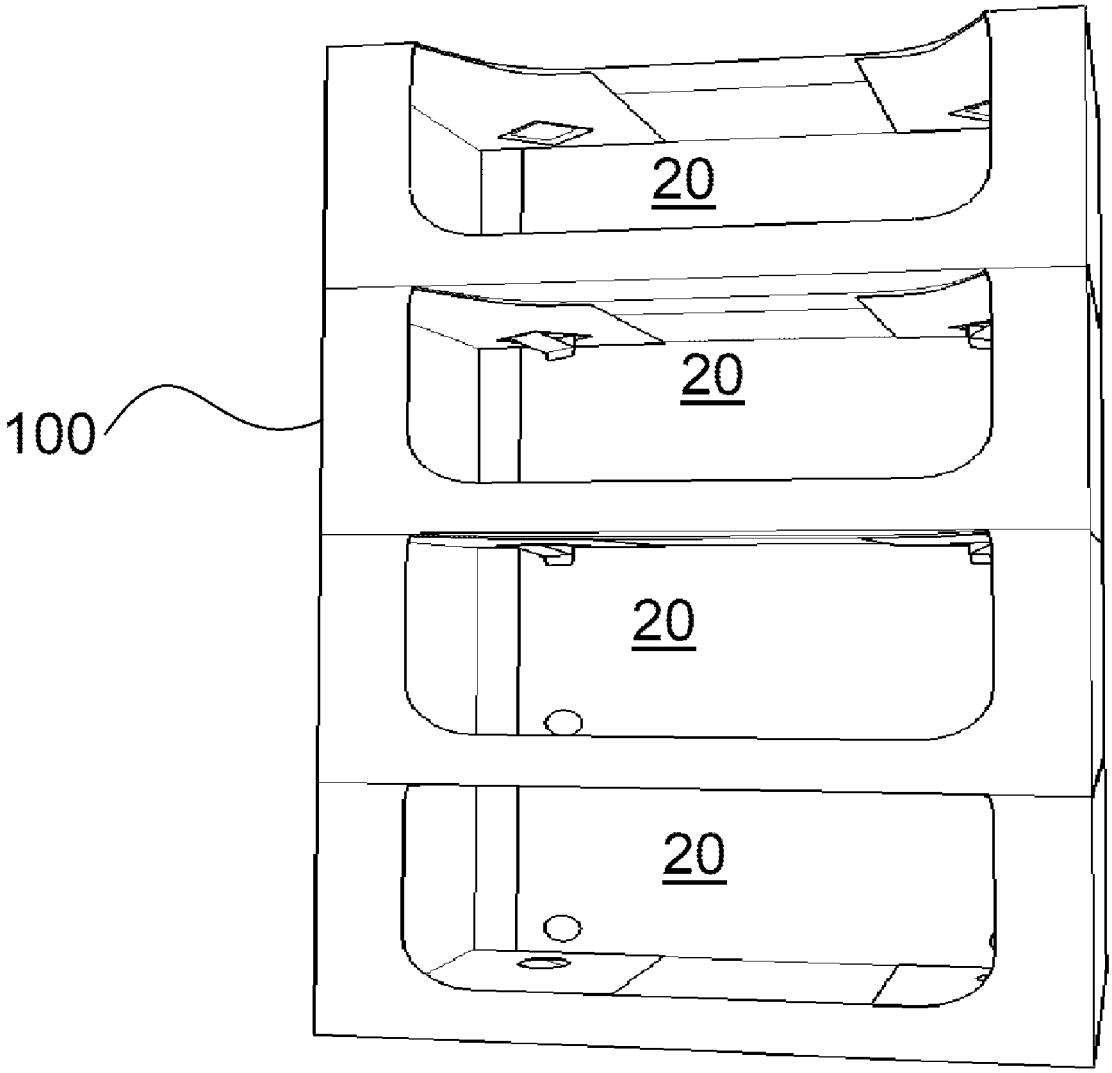
FIG. 10 is a perspective view of modified free standing display unit incorporating the boxes of FIGS. 9A-B.

FIGS. 9A-B are perspective front and rear views of a modified flat pack stackable interconnecting box 20 formed from a flat substrate which can be incorporated into a modified free standing display unit 100. The box 20 of FIGS. 9A-B use two locking tabs 66 and receiving tabs 64 as in the box 20 of FIGS. 4 and 5A-C, except these are located to the rear of the box 20. Additionally these show a pair side access ports 70 that allows the user to access and deploy the locking tabs 66 and associated receiving tabs 64 of an adjacent element even if the panel 62 is not removed. The access ports are shown in the embodiment of FIGS. 1-3 (not labeled) but are on the sides 44 rather than the back 42. The boxes 20 can form the free standing display unit 10 shown in FIG. 10. A base 10 and/or tray 30 may be added as desired.

Figure 11:
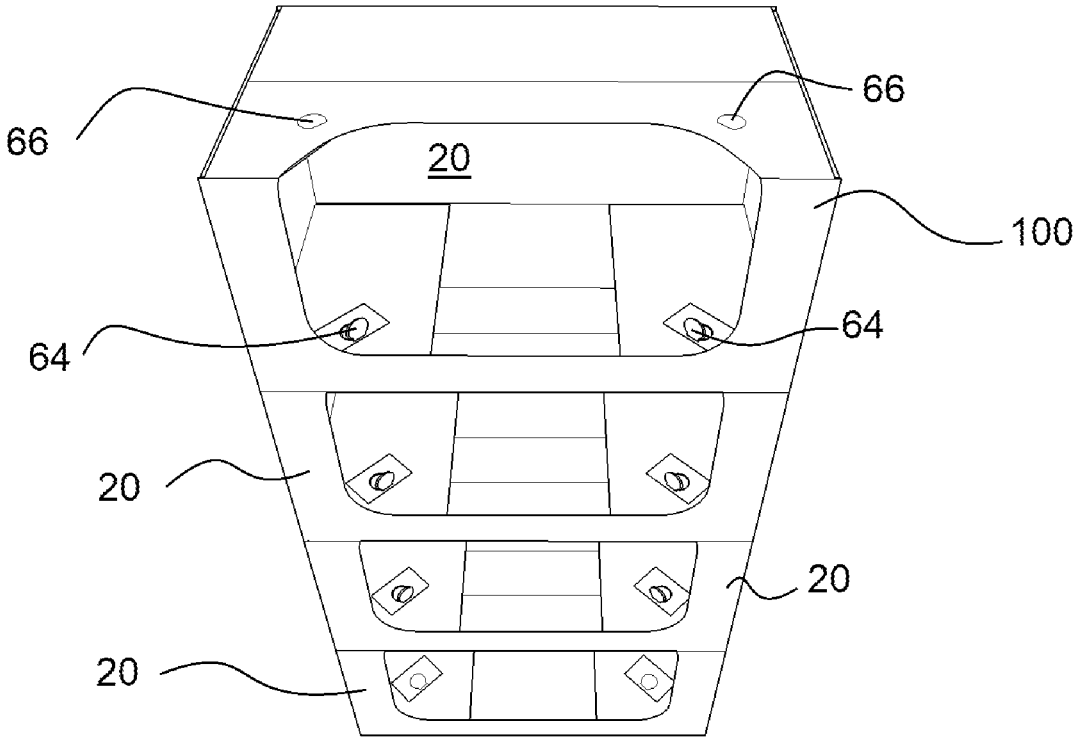
FIG. 11 is a perspective view of modified free standing display unit according to another embodiment of the invention.

FIG. 11 is a perspective view of modified free standing display unit 100 according to another embodiment of the invention. In this embodiment the position of the locking tabs 66 and the receiving tabs 64 are reversed with the locking tabs 66 on the top of the boxes 20 and the receiving tabs 64 on the bottom, with the user pushing up to interconnect the elements. This embodiment utilizes a "diverging" locking tab 66, namely a semicircle. The diverging locking element means the tab 66 is wider at its widest point than the width of the slot formed by the receiving tab 64 in the plane in which it is deployed. In other words when the tab 66 is deployed it cannot be pulled back through the opening formed by the receiving tab without first pivoting the locking tab 66 back to its original un-deployed position. Thus in this embodiment, when unstacking the boxes 20 the user will first manually push the tabs 64 and 66 back to their original position before unstacking. With the coupling on the top of the box this becomes easier. A trapezoid that increases in width farther from the hinge could also be used as a diverging locking tab 66 shape for this embodiment. In light of the manual repositioning the receiving tab 64 and the locking tab 66 will have hinges on the same side and not opposed as shown above. In this embodiment it is possible to eliminate the receiving tabs 64 and simply provide the associated opening that would be formed by the pivoted receiving tab 64.

The general concepts discussed above can be employed with a number of variations. For example the stacked boxes 20 of a free standing display unit 100 may have predetermined offset between the adjacent boxes to create a desired effect, such as a clockwise or counter clockwise twist to the boxes creating a helical look to the associated display unit 100. The graphics on the exterior of the box can be created to enhance such a desired effect. An alternative offset is that the upper boxes 20 are set back a predetermined amount to create a slight stairway effect. The offset backward stair effect could be coupled with a slight forward pitch to the base that creates a gravity feed fronting aspect within the boxes 20 and tray 30 of a unit. An alternative offset is that the upper boxes 20 are set forward a predetermined amount to create a distinctly different forward leaning effect, which could be offset with a compensating rearward pitch to the base resulting in a general horizontal display unit 100 with each tray 30 and box 20 having a slight incline to the rear of the box 20 or tray 30 for a gravity collection of the products (desired for some loose products).

Further the boxes according to the present invention need not all be deployed in associated free standing display units 100, as they could easily be placed on shelves and used as a point of sale display in that fashion. The users (often product delivery drivers) can elect not to interconnect the boxes 20 in a display 100 or only activate two of four interconnecting elements to save time as they see fit. The present invention is intended to allow them to give the customer/store owner whatever is appropriate for the give store without increasing the costs of the display unit 100 or boxes 20. The present invention does not add costs to the overall system and yield a flexible design with wide variability. The present invention provides an efficient, effective, flexible point of sale display incorporating stackable and unstackable product transport boxes. The present invention creates solid display 100 from loose pieces that can be unstacked and restacked with the same or different elements.

While this invention has been particularly shown and described with references to the preferred embodiments thereof, it will be understood by those skilled in the art that various changes in form and details may be made therein without departing from the scope of the invention. For example the present invention could be implemented in vertical coupling of side by side boxes of a display to prevent vertical movement.

What is claimed is:

1. A point of sale display comprising:

at least two stacked product transport boxes each having a planar bottom and planar top;

at least a pair of locking tabs on one of the planar bottom or planar top of each box, each locking tab having a hinge and sides extending from the hinge;

at least a pair of receiving openings on one of the planar bottom or planar top of each box, wherein each of the receiving openings on one of the stacked boxes align with one of the locking tabs on the other of the stacked boxes such that the locking tabs on the stacked boxes are selectively pivoted through the openings of the adjacent box to interconnect the boxes and prevent relative sliding in the point of sale display, and wherein the pair of locking tabs has one of straight sides or an inwardly tapered trapezoidal shape extending from the hinge to allow the boxes to be separated by pulling up on an upper box of the stacked boxes, wherein the pair of receiving openings are formed by receiving tabs each having a hinge, wherein the hinge of each receiving tab is on an opposite side of the receiving opening from the location of the hinge of the associated locking tab, wherein the locking tabs are configured to be moved into a deployed position that moves past the receiving tabs.

2. The point of sale display according to claim 1 wherein the hinges on at least two of the locking tabs are angled relative to each other.

3. The point of sale display according to claim 1 wherein the point of sale display is a free standing display unit.

4. The point of sale display according to claim 3 wherein the free standing display unit includes a base.

5. The point of sale display according to claim 3 wherein the free standing display unit includes a tray.

6. The point of sale display according to claim 3 wherein the boxes are flat pack cardboard boxes.

7. The point of sale display according to claim 6 wherein the boxes are six sided storage boxes.

8. The point of sale display according to claim 7 wherein the boxes include inner flaps on the planar bottom and planar top of each box wherein at least one inner flap includes an access opening aligned with one of the locking tabs or the receiving tabs.

9. The point of sale display according to claim 7 wherein each box includes a knock out panel.

10. The point of sale display according to claim 7 wherein each box includes access ports allowing the user to access and deploy the locking tabs.

11. A point of sale display comprising:

at least two stacked product transport boxes each having a planar bottom and planar top;

at least a pair of locking tabs on one of the planar bottom or planar top of each box, each locking tab having a hinge and sides extending from the hinge;

at least a pair of receiving openings on one of the planar bottom or planar top of each box, wherein each receiving opening is formed by receiving tabs each having a hinge, wherein each of the receiving openings on one of the stacked boxes align with one of the locking tabs on the other of the stacked boxes such that the locking tabs on the stacked boxes are selectively pivoted through the openings of the adjacent box to interconnect the boxes and prevent relative sliding in the point of sale display, wherein the hinge of each receiving tab is on an opposite side of the receiving opening from the location of the hinge of the associated locking tab, wherein the locking tabs are configured to be moved into a deployed position that moves past the receiving tabs.

12. The point of sale display according to claim 11 wherein the hinges on at least two of the locking tabs are angled relative to each other.

13. The point of sale display according to claim 12 wherein the point of sale display is a free standing display unit which includes at least one of a base or a tray.

14. The point of sale display according to claim 13 wherein each box includes access ports allowing the user to access and deploy the locking tabs.

15. A point of sale display comprising:

at least two stacked product transport boxes each having a planar bottom and planar top;

at least a pair of locking tabs on one of the planar bottom or planar top of each box, each locking tab having a hinge on one end and sides extending from the hinge;

at least a pair of receiving openings on one of the planar bottom or planar top of each box, wherein each of the receiving openings on one of the stacked boxes align with one of the locking tabs on the other of the stacked boxes such that the locking tabs on the stacked boxes are selectively pivoted through the openings of the adjacent box to interconnect the boxes and prevent relative sliding in the point of sale display, and wherein the hinges on at least two of the locking tabs are angled relative to each other, wherein the locking tabs are configured to be moved into a deployed position that moves past the receiving tabs.

16. The point of sale display according to claim 15 wherein each box includes access ports allowing the user to access and deploy the locking tabs.

* * * * *